US006276549B1

(12) United States Patent
Fasci et al.

(10) Patent No.: US 6,276,549 B1
(45) **Date of Patent: *Aug. 21, 2001**

(54) MODULAR CONTAINER THAT CAN BE INTERCONNECTED, FOR MULTIPLE USES

(76) Inventors: Mirta Mabel Fasci, San Martin 686, 7°of. "A"- 1004, Buenos Aires (AR); Luis Orland de Jesus Pittau, San Martin 686, 7°"A"- 1004, Buenos Aires (AR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,327

(22) Filed: Jan. 20, 1998

(30) Foreign Application Priority Data

Feb. 7, 1997 (AR) ..... M970100488

(51) Int. Cl.[7] ..... B65D 21/02

(52) U.S. Cl. ..... 220/23.4; 220/23.6

(58) Field of Search ..... 220/23.4, 23.6

(56) References Cited

U.S. PATENT DOCUMENTS

| | | | | |
|---|---|---|---|---|
| 3,194,426 | * | 7/1965 | Brown, Jr. | 220/23.4 |
| 3,369,658 | * | 2/1968 | Hasselmann | 220/23.4 |
| 3,374,917 | * | 3/1968 | Troy | 220/23.4 |
| 3,554,384 | * | 1/1971 | DeNatale | 220/23.4 |
| 3,635,350 | * | 1/1972 | Wolf | 220/23.4 |
| 3,683,549 | * | 8/1972 | Simmon | 220/23.4 |
| 3,763,980 | * | 10/1973 | Vom Stein et al. | 220/23.4 |
| 3,862,683 | * | 1/1975 | Koelichen | 220/23.4 |
| 4,624,383 | * | 11/1986 | Moore | 220/23.4 |

* cited by examiner

*Primary Examiner*—Joseph M. Moy
(74) *Attorney, Agent, or Firm*—Pendorf & Cutliff

(57) ABSTRACT

Modular containers that can be interconnected, for multiple uses of the type that, forming a bottle or similar thing, of structure and materials usually developed for their disposal, essentially includes a bottom and lateral walls finished in a top wall. This top wall is prolonged in a neck delimiting an access mouth to an interior or the container that can be shut by means of a cover that is removable. The lateral walls, as do those of the bottom and top, possess means of lateral and top interconnection with other containers of similar characteristics, including compatible recesses and salients and of reciprocal fit through initial, but not continuous pressure.

36 Claims, 8 Drawing Sheets

Figure 1A:
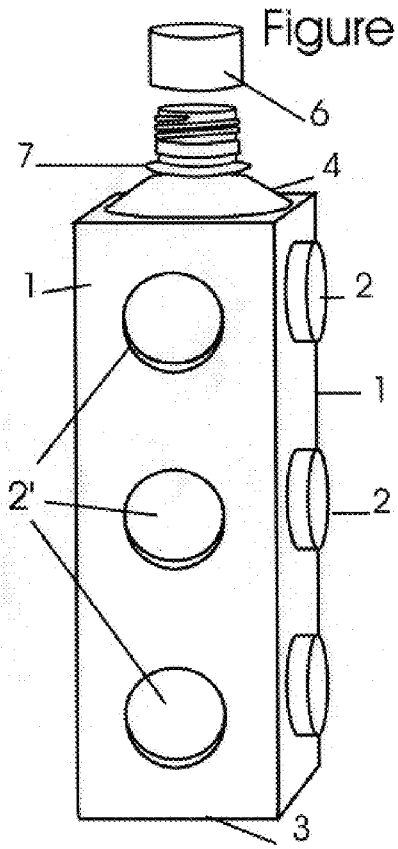

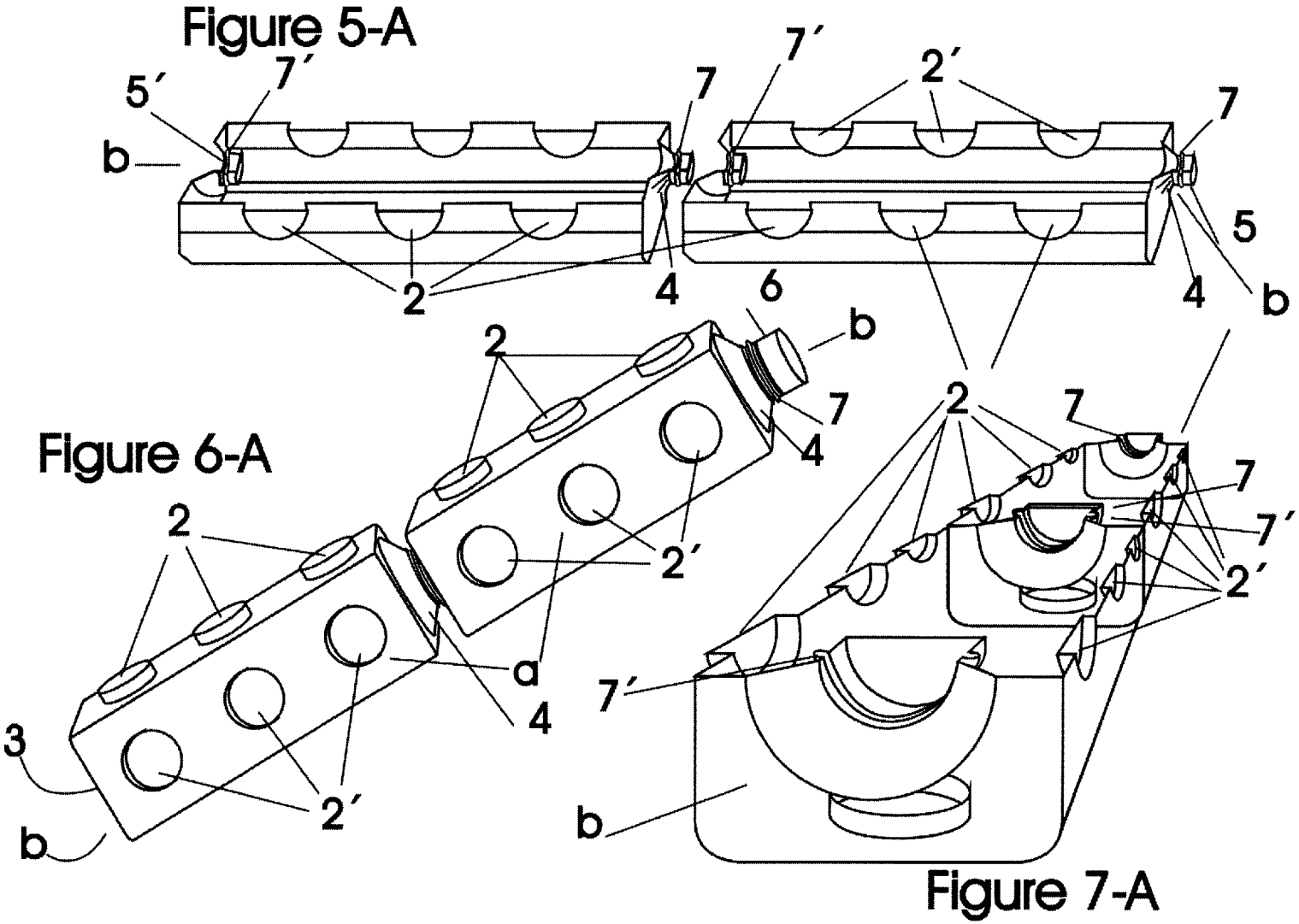
7
5
b
4
2´
7´
7
4
2
7´
5´
b
Figure 5-A
b
7
4
6
2´
2
a
4
2´
2
3
b
Figure 6-A
7
7´
2´
7
2
7´
b
Figure 7-A

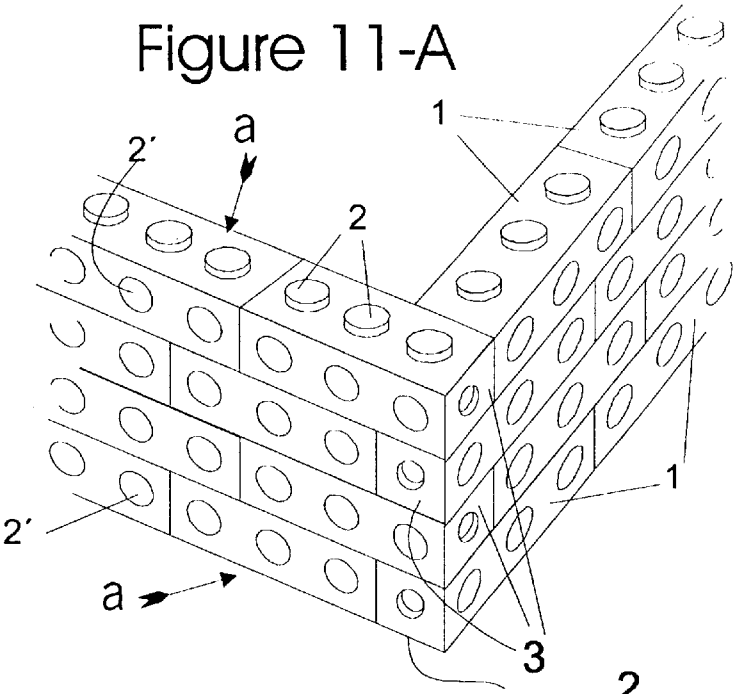
Figure 11-A
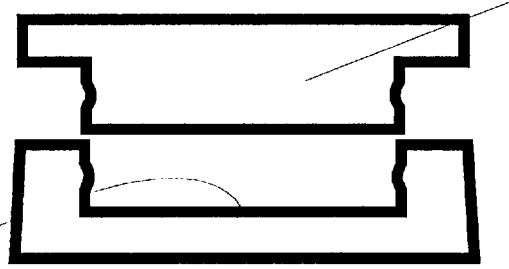
Figure 12-A
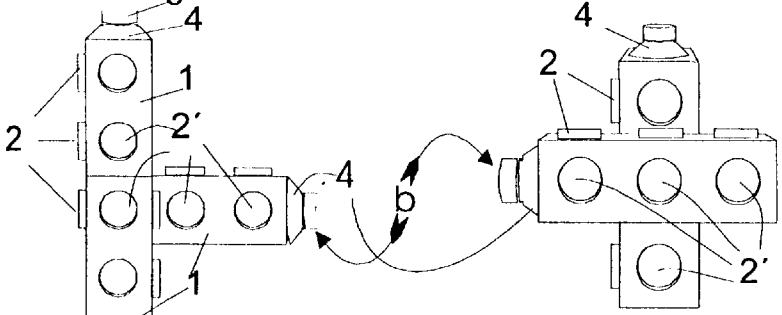
Figure 8-A
Figure 9-A
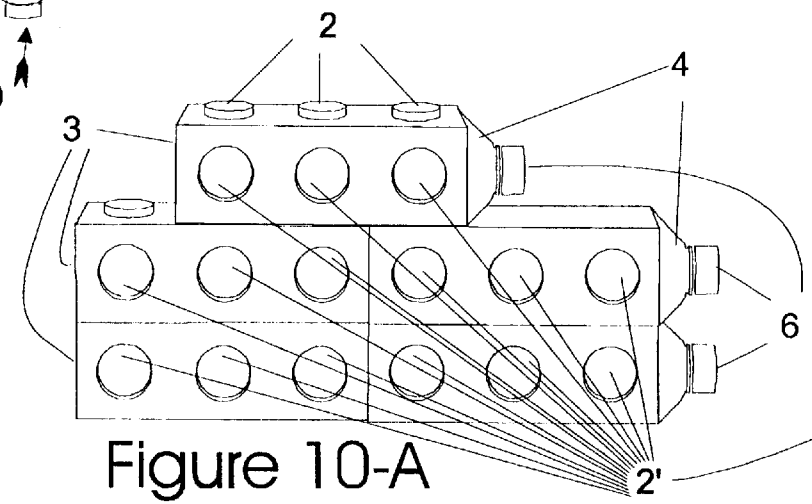
Figure 10-A Figura 13-B
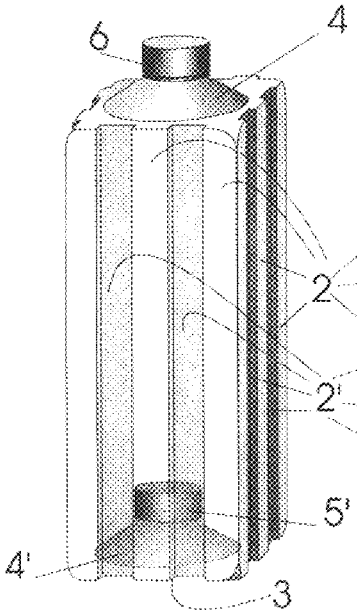
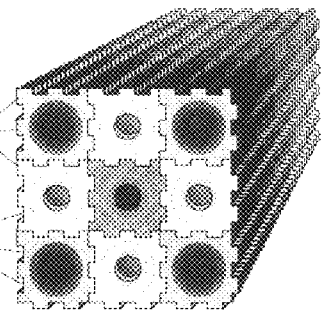
Figura 14-B
Figura 18 D
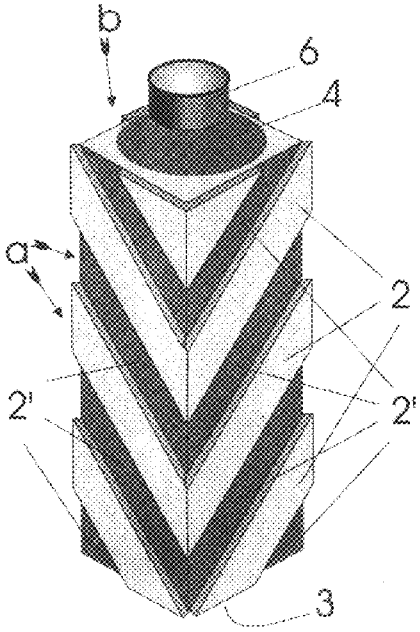

Figura 15 C
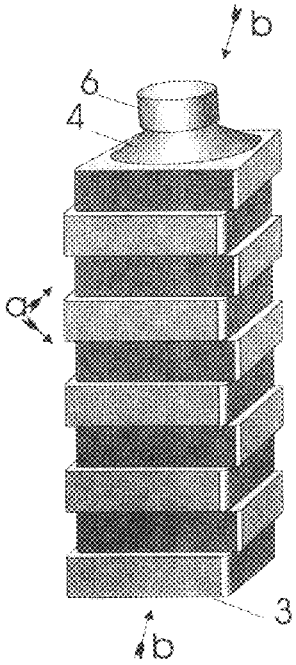
Figura 16 C
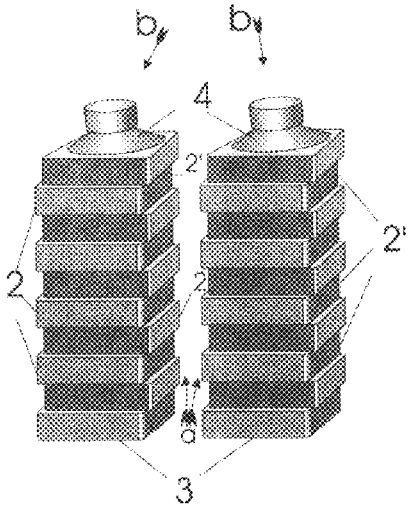
Figura 17C
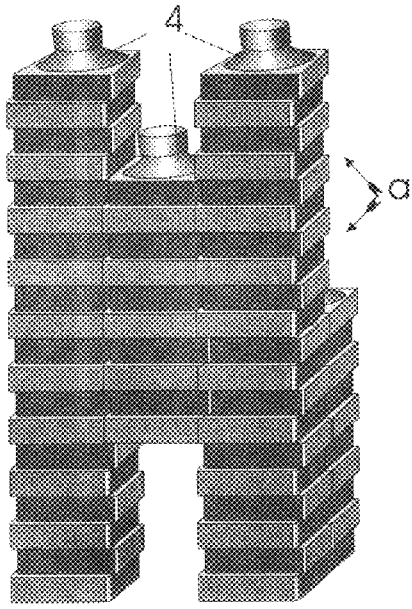

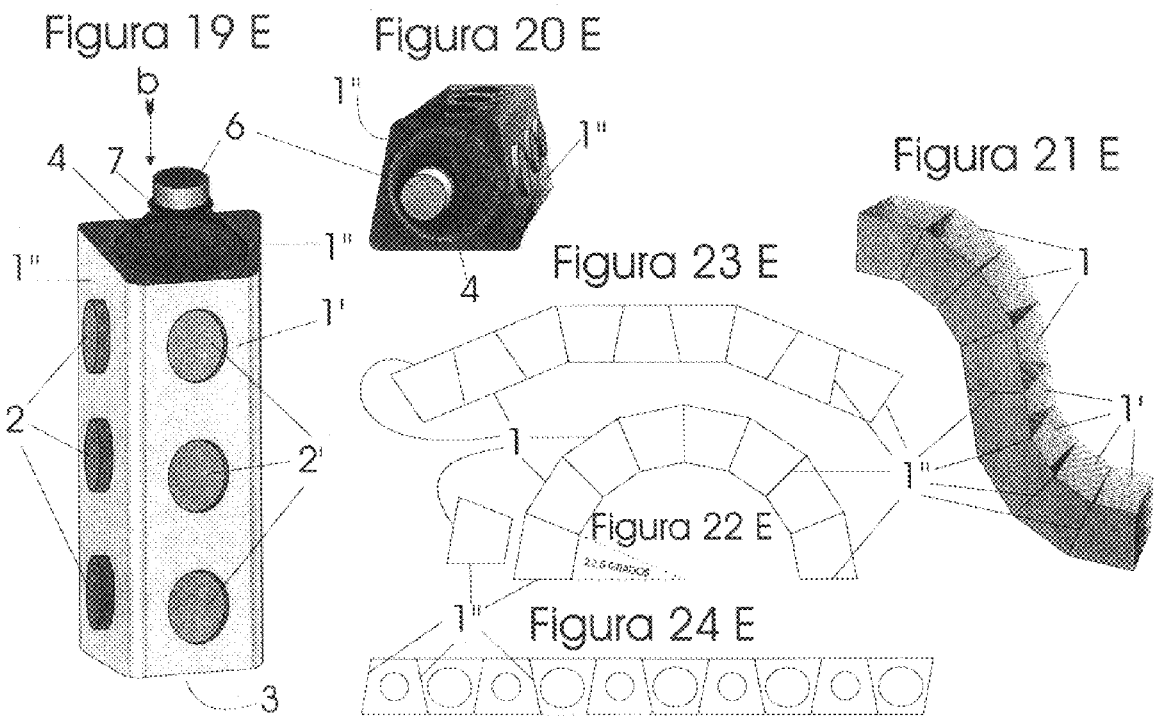
Figura 19 E
b
4
7
6
1"
1"
1'
2
2'
3
Figura 20 E
1"
1"
4
Figura 21 E
1
1'
Figura 23 E
1
1"
Figura 22 E
1"
Figura 24 E Figura 25
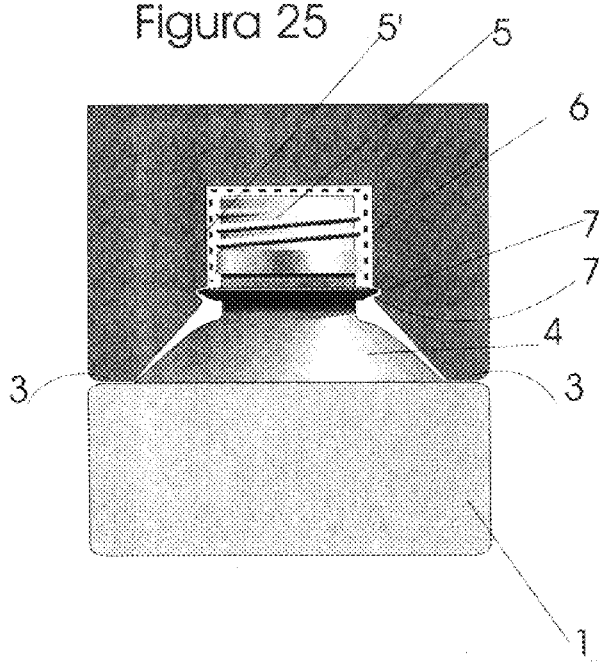
Figura 26
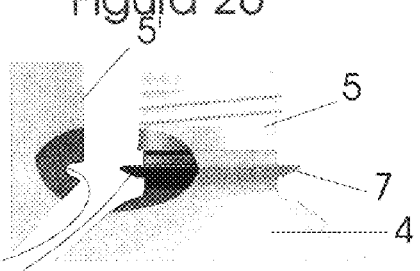
figura 27
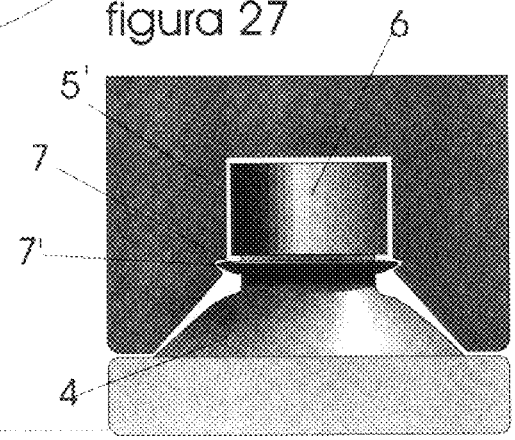

MODULAR CONTAINER THAT CAN BE INTERCONNECTED, FOR MULTIPLE USES

BACKGROUND AND SUMMARY OF INVENTION

The present utility model refers to a new modular container that can be interconnected, for multiple uses; its aim being to favor the conditions for the reusing of containers, especially of the type produced for its later discard.

As it is public and notorious, in the last decades the whole world has been flooded with products with disposable containers that, although they facilitate their employment and reduce derived operative costs of their recovery, (such as the collection, classification, cleaning, transport and storage, etc.) they constitute, on the other hand, one of humanity's bigger ecological problems since, once used it is not known that to do with them.

The problem is increased when such disposable containers are not structured in biodegradable material; by which its discardal is but the simple transfer of the containers from a place to another, without its raw material being degraded.

Within a wide variety of disposable containers—non degradable—that are known, the plastic bottles are without a doubt those that constitute the biggest volume, following them in order, the metallic cans.

Given that, to give an approximate idea of the quantity of containers that are discarded in the world, it is enough to point out the cans that are discarded in Argentina only, approximately 600 million cans are thrown per year. In the particular case of the city of Buenos Aires and the metropolitan area, during the year 1996 4.500.000 tons of garbage of the most diverse materials were collected; the plastics composing 15%, particularly under the form of containers.

It is so the final destination of the plastic bottles ends being that of the land fills and dumps, as well as those denominated "sanitary fillers", which produces a high proportion of environmental contamination, obstructing pipes and mouths of drainages and, mainly, forming true mantels or strata in all type of lands that do not even serve as effective filler material.

There usually exist three forms for facing the problem of the disposable containers (that are not biodegradable):

1—The destruction of the containers:

By means of mechanic shredding or crumbling: This process, although it facilitates the volumetric reduction of the containers, does not modify the impossibility of degradation of its material.

By means of its burning: Maybe this process is the less recommended of all, since the combustion of some plastic substances (as PVC, for example), is highly polluting.

By means of the action of chemo-destructive agents: Containers have been tried to be eliminated gathering them in big reservoirs where diverse chemical substances are overturned; but such processes had no acceptance, mainly due to the high operative costs, their limited yield; in certain extent, they are also pollutants (since they generate noxious vapors); and to the fact that, in general, they usually produce a residual material anyway.

2—The reusing of the containers:

This resource, although useful, is employed in a limited proportion, fundamentally, it depends on the contained product (for example, the reusing of disposable containers is not allowed when foodstuffs and medicinal products are concerned). Also, the packed original product contaminates the new content, and it is not always possible to make the containers hygienic, particularly when they are of s frail structure (as for example, those produced in blowing processes).

3—The recycling of the material of the containers:

This resource is also acceptable, because it constitutes a form of use of the container; but it has several inconveniences: in the first place, because as from its first use it is polluted with diverse substances—inclusive those that constituted its first content—and that, to eliminate them, requires of relatively expensive processes; in second place, because the recycled plastic does not keep the properties of the original raw material and, therefore, it presents diverse practical inconveniences, such as premature aging, a greater fragility, a poor presentation due to the combining of pigments, etc.

Due to the abovementioned, only a minimum proportion of plastic bottles end up being reused, or recycled.

The invention that is described in the present documentation, constitutes an ingenious resource that facilitates the reusing of disposable containers—such as plastic bottles—with a different utilitarian end.

In essence, it is related to the production of a new type of disposable container—so much in the lateral walls as in the top and bottom parts—provided of means of reciprocal interconnection with other containers of the same characteristics; so that, instead of throwing them, you can stimulate the accumulation of the empty containers to compose structures of all type and application, such as recreational, functional, ornamental, etc.

In this way, for example, in a constructive aspect, the bottles that can be engaged in the form of modular blocks that can constitute an interesting solution to the housing problem. So that the transparent empty blocks conform panels, or part of the same enabling the light to pass through the same, cooperating with the environmental natural illumination as well as to the saving of energy.

Also, in such an application, if to the modular blocks component of each container reused in this manner are left empty, (containing only air) they constitute a thermo-insulating structure; while if they are filled with sand, earth or another appropriate pulverulent or granulated material, this confers them a greater inertia and, in the event of being used a dark material, may also retain the heat of the solar rays to offer more comfort to a house during the night.

Similarly, the new containers can be interconnected to form recreational or didactic composition games,—circumstance that is valuable to give opportunity to children and youngsters to develop their genius—, and to contribute to the use of a non pollutant in their environment.

It is foreseen that the connections can be carried out forming structures so much straight as well as uneven, undulant, arched and, even annular segmented.

The engaging among each two consecutive bottles by their top end and by their bottom end, can be carried out with a threaded neck with or without their cover; including, also, said engagings, means of retentive fit that prevent the modular elements from disconnecting spontaneously.

In fact, the new system can be applied in everything that the imagination is able to conceive, returning to Man the capacity to imagine, allowing him to apply his genius in the conception of the most diverse structures and configurations, and to carry them out with his own hands, to transform disposable containers in utilitarian and aesthetic systems. That is to say, to make from the useless and harmful, an innovative and useful employment.

ILLUSTRATION

For better clarity and understanding of the utility model, it has been illustrated with several figures in which it has been represented in one of its favorite embodiments, everything as an illustrative example, not limitative, in which figures indicated with a letter corresponds to a same type of embodiment; being:

FIG. 1-A is a view in perspective of the modular container that can be interconnected in which the means of male and female engaging are inlet and outlet in a cylindrical way. It can be seen that the same are disposed in the lateral faces and guided in the longitudinal sense of the container.

Figure 2A:
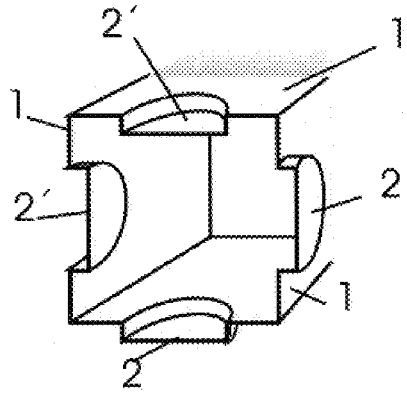

FIG. 2-A, is a traverse section in perspective of the container, that allows to clearly appreciate how the mentioned male-female engaging means are disposed and conformed starting from the respective walls.

Figure 3A:
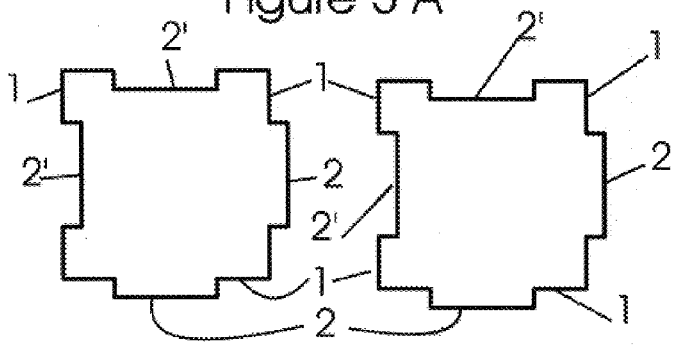

FIG. 3-A, is a schematic view in traverse section of two containers in the form of a bottle with circular male-female engagings, indicating how the lateral connection takes place according to the arrow.

Figure 4A:
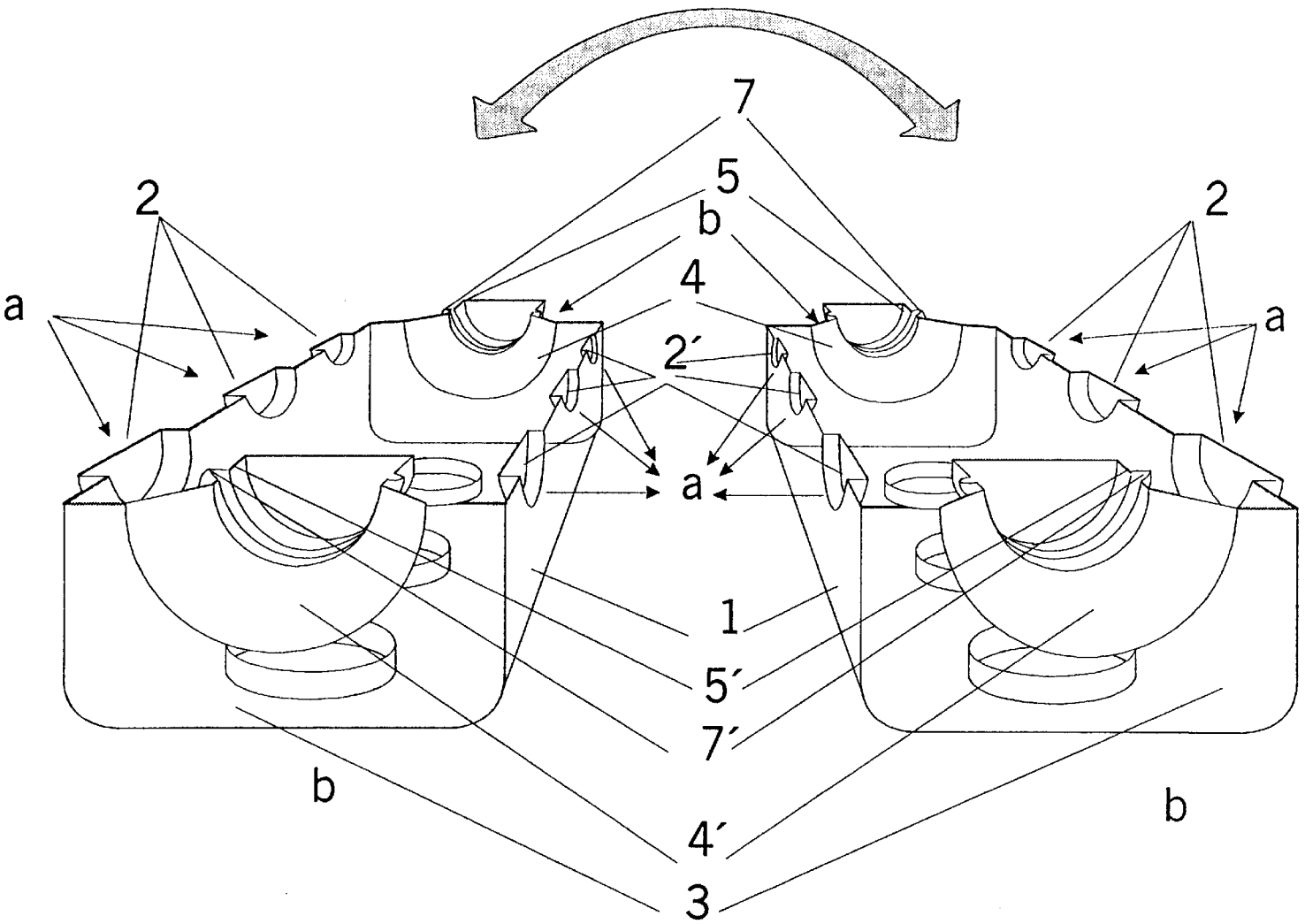

FIG. 4-A, is a lengthwise view in perspective of the container cut in two, and observed from its bottom or base, to show the conformation of the same, of compatible engaging with the neck, with or without its cover.

FIG. 5-A, are two containers cut lengthwise and represented in perspective to show the way in which the end interconnection of the bottles takes place according to the present invention.

FIG. 6-A, is a view in perspective of two containers in circumstances of being interconnected by their ends (top and bottom) of reciprocal engaging.

FIG. 7-A, is a longitudinal section in perspective of two containers as shown in FIG. 4-A, already interconnected by the reciprocal rim of the top wall and neck of one in the cavity of the bottom of the other one.

FIG. 8-A, is a form of connection of the container according to the embodiment of FIG. 1-A that shows three interconnected bottles: two of them in a colinear manner by their coupling ends—top and bottom—and the third, forming 9° with the first and second bottles.

FIG. 9-A, is another form of connection of the container according to the embodiment of FIG. 1-A that shows two containers connected in the form of a cross.

FIG. 10-A, is another form of connection of the container according to the embodiment of FIG. 1-A that shows superimposed lines of containers interconnected laterally by its ends and by two of its opposite lateral walls, forming a wall.

FIG. 11-A, is another way of connection of the containers according to the embodiment of FIG. 10-A that shows how two walls formed by containers can be connected and concurrent to an corner area.

FIG. 12-A, is a schematic detail in traverse section and increased scale of a set of engaging reciprocal male-female means between two modular containers; this increased detail of the profile of the sides of reciprocal rim, shows the formation of slots or grooves dedicated on one hand to cooperate with the security of the connection, and on the other part to allow the exit of the air occluded in the female cavity.

It is a lateral view of a container in which the lateral interconnection means are rectangular and they are guided in the traverse sense of said container.

FIG. 13-B, is a view of a bottle according to the present invention, but with its means of engaging conformed and disposed according to a new embodiment in which the same consist in straight and rectangular inlets and outlets that, alternately, extend all along the lateral walls of said container, the top coupling means being disposed and conformed in an identical way as in FIGS. 1 through 12-A.

FIG. 14-B, is a schematic traverse section of a plurality of containers conformed according to the embodiment in FIG. 13-A, showing the way in which the lateral interconnection can take place with the mentioned means.

FIG. 15-C, shows a perspective of the bottle according to the reference invention in a new of embodiment in which the inlet and outlet lateral interconnection, are straight and are traversely disposed.

FIG. 16-C, is a perspective of two bottles according to the embodiment of FIG. 15-C, showing the way in which the mechanical connection takes place among the same by means of straight traversal couplings.

FIG. 17-C, is a schematic view in elevation of different bottles interconnected with union, and according to the embodiment of FIGS. 15 and 16-C.

FIG. 18-D, is another way of embodiment that, maintaining the basic concepts of top and bottom couplings bottom, as well as the means lateral coupling, in this case it presents the particularity that this lateral coupling means consist on alternate straight projections with straight recesses, of male-female connection, but they are guided sidelong with regard to the longitudinal geometric axis of each lateral wall.

FIG. 19-E, is a view in perspective of the container, in which its format has been modified since, instead of the cylindrical or prismatic form is, in this case, of trapeziform traverse section.

FIG. 20-E, is a view of the embodiment 19-E of the container, shown in perspective from its top wall, to observe how it can lean on by one of its faces, for example, the mayor base of the particular trapeziform sectional configuration.

FIG. 21-E, is a view of several containers of trapeziform traverse section, interconnected by the lateral coupling means according to the invention, forming an undulant body.

FIG. 22-E, is a variant of application of the connected trapeziform containers forming an arch.

FIG. 23-E, is another variant of application of the connected trapeziform containers forming a body of straight segments.

FIG. 24-E, is another variant of application of the connected trapeziform containers forming a straight structure.

FIG. 25, is a detail in section and in an increased scale in relation to that of the previous figures that shows the way in which the longitudinal coupling between two containers—of equal characteristics—takes place—by means of the entrance of the neck—without the cover that is shown here in a dotted line—of one of the containers in the female coupling depression or lid formed in the external cavity of the bottom of the other container; also, in this figure it is clearly observed how the annular indented cord, as from which the neck of the container is born, fits retentively in a compatible ring groove provided by the female cavity of the other container, to assure the positional retention of the coupling.

FIG. 26, is a detail of the neck of a container, without its cover, indicating how it is that can be fitted into the annular cord in the compatible groove of the other container; and finally, FIG. 27, the same detail of FIG. 27 that shows a container with the cover locked in the compatible cavity of the other and positionally locked by the reciprocal rim of the cord and annular groove of said containers.

In the different figures, the same reference numbers indicate same or corresponding parts, and the groups of several elements have been pointed out with letters.

LISTING OF THE MAIN REFERENCES (7') annular retentive groove of (7).

DESCRIPTION OF THE PREFERRED EMBODIMENTS

To the specified ends, the new modular container that can be interconnected, for multiple uses, is of the type that, conforming a bottle or similar thing,—of structure and materials usually developed for their disposal—, essentially includes a bottom (3) and lateral walls (1) finished in a top wall (4); and this top wall (4), is prolonged in a neck (5) delimiting an access mouth to its interior, that can be shut by means of a cover (6) that can be removed; characterized because so much the lateral walls (1) as those of the bottom (3) and top (4), possess means of lateral and top interconnection (a) with other containers (A) of the same characteristics.

In general terms, and as it was already anticipated, the invention refers to a container that essentially can conform a plastic bottle or similar its structure and materials being usually developed for its disposal, after the use of content. These type of bottles essentially include a bottom (3) in which the lateral walls (1)origin, finishing in a top wall (4) that can be plane, or forming arched shoulders, in form of cone trunk, etc.; being prolonged the same one in a neck (5) that, in form of tubular mouthpiece, it defines an access mouth to the interior of the bottle, that can be shut by means of a cover (6) that can be removed (that can be fit by threading, pressure, etc.).

In the case of the present invention, the modular bottle that can be interconnected possesses interconnection means (a) and with other containers of the same characteristics.

The interconnection means (a) are disposed in lateral walls (1), while they make it in a combining manner in their bottom (3) and in their top wall (4).

In this way, so much the lateral walls (1) as the top and the bottom of each container possess means of lateral and top interconnection (a),. [See FIGS. 1-A, 4-A, 13-B, 15-C, 18-D]; which allows this type of container—once they are empty—to be reused with recreational, didactic, functional ends, etc. by means of reciprocal joinings (as for example, those illustrated in FIGS. 3-A, 5-A, 6-A, 7-A, 8-A, 9-A, 1-A, 11-A, 12-A, 14-B, 16-C, 21-E, 22-E, 23-E, and 24-A in a non limitative way).

Essentially, the means of lateral interconnection (a) consist in inlets and outlets conformed in the lateral walls (1) of the bottle as means of lateral engagings male (2) and female (2') that are compatible to each other.

In a favorite form of embodiment the mentioned lateral male engagings (2) are constituted by cylindrical salients that constitute coupling buttons compatible with the lateral female engagings (2') that are incoming or equally cylindrical cavities. These means of lateral interconnection (a) are disposed in the lateral walls (1) guided in the longitudinal sense of the bottle, and aligned on a same axis and so that the opposite lateral walls (1) have different engagings (2) and (2'). In this way while a lateral wall (1) has lateral male engagings (2), the opposite lateral wall (1)—or, in its case, the adjacent one—possesses lateral female engagings (2'). [See series of figures A].

The employment of male female coupling lateral means (b) in a cylindrical way, besides simplifying the connection, has the advantage of facilitating the relative rotation among pieces connected by a single set of means (2)–(2'), if it were required to (FIG. 9-A). But, equally, the salient ones in form of buttons (2) can be polygonal as well as hexagonal, pentagonal, etc.; and should be of the same format compatible with the female coupling means (2')

In other embodiments the means of lateral interconnection (a) among bottles can be constituted by lateral male (2) and female (2') engagings of different conformation. In this way, the same (2)–(2') can be straight alternate inlet and outlet of parallelopiped rectangular configuration, disposed alternately in each lateral wall (1),as observed in the series of figures of the embodiments B, C and D. In different embodiments, these lateral engagings (2)(2') can be guided so much in the longitudinal sense of the bottle (FIG. 13-B and their form of connection 14-B), as well as in the traverse sense (FIG. 15 to 17-C); and even oblique (FIG. 18-D).

Preferably, the lateral faces—dedicated to enter in reciprocal contact in the salients (2) and recesses (2')—have a slotted or grooved design (like schematized in the section of FIG. 12-A), with the purpose of offering a greater coupling retention and to facilitate the exit of the air (since, being the same occluded, its pressure would tend to produce the spontaneous disengagement).

With regard to the means (b) of extreme interconnection between the top of a bottle and the bottom of another of the same type, which are those shown in FIGS. 4, 5, 7, 13, 25, 26 and 26. In general, the same consist on a salient in the way of a male coupling,—conformed by the top wall (4) of the bottle—, compatible with a recess that defines the external face of the bottom (3) of the bottle More particularly, the top wall (4) of the bottle that conforms the shoulders of the same (plane, arched, conical, etc.), toward the proximal extremity of the same container it gradually reduces its traverse section, to finish in the neck (5) that can be threaded or with projections to allow the fit of a cover (6) that can be removed. In a concordant way, the bottom wall (3), by way of a means of female connection with the top wall (4) and its neck (5), conforms a concavity (4') of size and format compatible with the mentioned shoulders, also including a central depression compatible with the neck (5) of the bottle; being able to produce the coupling of the mentioned neck (5) in direct form, (FIG. 25 and 26), or still providing its lid (6), FIG. 27.

Note that, preferably, it has been foreseen that the neck (5) of the bottle, beginning or possessing a salient or annular cord (7) projected from the periphery of said container and finished in the form of and annular tooth (FIGS. 25 to 27).

This projection can be of the type that usually certain container type has to hold the bottles, as a resistant handle (since the necks are usually relatively short); undoubtedly in this case it is used to fit in an annular groove (7') which—compatible in format and disposition with the mentioned cord (7)—during the coupling that is indicated in FIGS. 25 and 27, this groove works as retentive rim of the coupling, avoiding the component parts to come out, unless forced to it.

In agreement with the mentioned forms, the cavity (4') of the bottom wall (3) can be rounded concave, or infundibuliform with a concave portion. In this last case the concave portion can have a trunk-conical form, in a case, or trunk-pyramidal in another. In all the cases the concave portion is provided of a central depression compatible with the neck (5) of the bottle.

In another embodiment form the cavity (4') of the concave bottom (3) conforms a female top coupling (5') that is in size and shape compatible with the neck (5) of the bottle, without its cover (6). This coupling (5') can have nerves or internal projections that define a lightly smaller interior diameter to the exterior of said neck (5), so that the male-female interconnection among the mentioned neck (5) of a bottle, and the coupling (5') of the central cavity (4') provided by the bottom (3) of another bottle, is able to take place by pressure forced fitting.

In synthesis the union of the modular bottles that can be interconnected by means of their respective lateral male (2) and female (2') engagings, as well as by means of their necks (5) and coupling tops (5') allows the constitution of groups in diverse ways and applications, from imaginative devices to structural groups as walls. [such as those shown as simple illustrative examples, not limitative, in FIGS. 3-A, 5-A, 6-A, 7-A, 8-A, 9-A, 1-A, 11-A, 12-A, 14-B, 16-C, 21-E, 22-E, 23-E, and 24-A].

In what concerns to the format of the container itself, this can be cylindrical, square prismatic, square octagonal prismatic, hexagonal prismatic(to allow constructions in the shape of "beehives"), etc.; although always maintaining the principle of the lateral and end coupling means which constitutes the essence of the invention.

Another of the possible ways of embodiment of this format—helping to favor the reusing of the bottles up to now discarded—is to give to the same a format of trapeziform traverse section (illustrated in FIGS. 19-E, 20-E, 21-E, 22-E, 23-E and 24-E), defined by the mayor base (1), the minor base(1') and the sides (1").

With this form, according to the position in which the sides (1") of the connected bottles are coupled, one may obtain undulant conformations as those of FIG. 21-E, segmented as in FIG. 23-E, arched like in 22-E which, completed, can define a complete circle; straight line as in FIG. 24-E; etc.

In all the cases, the bottles connected in this way, being any its form and the type of the used joining means, allows to build walls or hollow, insulating structures, or filled with diverse materials such as earth, sand, etc.

It is certain that being the present invention taken into practice, modifications will be able to be introduced respecting construction and shape details, without it implying to part from the fundamental principles that are clearly substantiated in the claim clauses that follow.

Being this way especially described and determined the nature of the present utility model, and how it can be taken into practice, it is declared to claim, as of exclusive right and property:

1. A plurality of modular containers that can be interconnected, for multiple uses and reutilization, each said container comprising:

a bottom surface, a top surface, and lateral walls that are joined to one another via the bottom surface and the top surface; and said top surface having a prolonged neck delimiting an access mouth to an interior of said container, said access mouth being shuttable using a cover that can be removed; wherein the lateral walls and the bottom and top surfaces possess means for lateral and top and bottom interconnection with others of the plurality of modular containers to compose structures of all types and applications, the prolonged neck has a ring cord projecting from the periphery thereof, the ring cord is wider than the cover and has a ring groove memory that works as a retentive rim at the means for interconnection which includes compatible recesses and salients and of reciprocal fit through engaging pressure, the ring groove memory preventing rotation of the modular containers about the means of interconnection.

2. A plurality of modular containers that can be interconnected, in accordance with claim 1, wherein the means for lateral interconnection are recesses and salients conformed in the lateral walls of the container as male-female engaging means, compatible to each other and disposed along said walls.

3. A plurality of modular containers that can be interconnected, in accordance with claim 2, wherein the means for lateral interconnection are guided in the longitudinal sense of the container.

4. A plurality of modular containers that can be interconnected, in accordance with claim 2, wherein the means for lateral interconnection are guided in the traverse sense of the container.

5. A plurality of modular containers that can be interconnected, in accordance with claim 2, wherein the means for lateral interconnection are guided at an angle with regard to the longitudinal geometric axis of the container.

6. A plurality of modular containers that can be interconnected, in accordance with claim 2, wherein the means for lateral interconnection are alternate recesses and salients compatible to each other that constitute male-female engaging means with the equivalent recesses and salients provided by the lateral walls of other containers similar to those with which they are laterally connectable.

7. A plurality of modular containers that can be interconnected, in accordance with claim 2, wherein the means for top interconnection includes a salient conformed in the top surface of the container, compatible with recesses conforming in the bottom surface an external cavity, as male-female engaging means among said top surface of each container with regard to said cavity of the bottom surface of another similar container.

8. A plurality of modular containers that can be interconnected, in accordance with claim 2, wherein the compatible salients and their recesses are circular.

9. A plurality of modular containers that can be interconnected, for multiple uses in accordance with claim 2, wherein the compatible salients and their recesses are alternate nerves with straight recesses.

10. A plurality of modular containers that can be interconnected, for multiple uses in accordance with claim 7, wherein the means for top interconnection of a container with the cavity and central depression in the bottom of another container of similar characteristics includes a neck born in the top shoulder of the container, starting from a surrounding cord that is projected to form an annular tooth of retention against an annular groove, compatibly provided by the cavity of the bottom surface.

11. A plurality of modular containers that can be interconnected, for multiple uses in accordance with claim 7, wherein the top surface of the container, conforming shoulders on the top surface toward a proximal extremity gradually reduces its traverse section, ending the formation of the neck; while, the bottom surface as a female connection means with the top and its neck includes a cavity of size and format compatible with the shoulders and that includes a central depression compatible with the admission of the neck of another container of similar characteristics.

12. A plurality of modular containers that can be interconnected, for multiple uses in accordance with claim 11, wherein the shoulders are rounded convex.

13. A plurality of modular containers that can be interconnected, for multiple uses in accordance with claim 11, wherein the shoulders are in the form of a cone trunk whose smaller base is prolonged conforming the neck of the bottle.

14. A plurality of modular containers that can be interconnected, for multiple uses in accordance with claim 7, wherein shoulders on the top surface are in trunk-pyramidal shape whose smaller base is prolonged conforming the neck of the container.

15. A plurality of modular containers that can be interconnected, for multiple uses in accordance with claim 10, wherein the external cavity of the bottom surface is rounded concave, and includes a central depression compatible with the neck of the container; and an adjacency area among the central depression and said cavity of the bottom surface, and which includes an annular groove compatible with an annular cord of the neck.

16. A plurality of modular containers that can be interconnected, for multiple uses in accordance with claim 9, wherein the cavity of the bottom surface is infundibuliform, with a concave portion in the form of a cone trunk including a central depression compatible with a neck of another bottle of similar characteristics and an annular groove, in turn compatible to a retentive fit of an annular cord of the outer compatible bottle which is connectable to the same.

17. A plurality of modular containers that can be interconnected, for multiple uses in accordance with claim 9, wherein the cavity of the bottom surface is infundibuliform, including a concave portion in a concave trunk-pyramidal shape, provided of a central depression compatible with the neck of the bottle.

18. A plurality of modular containers that can be interconnected, for multiple uses in accordance with claim 9, wherein the central depression of the concave bottom is in size and shape compatible with that of the neck and an annular cord of the container and its cover.

19. A plurality of modular containers that can be interconnected, for multiple uses in accordance with claim 15, wherein the central depression of the concave bottom is in size and shape compatible with that of the neck and an annular cord of the container lacking its cover.

20. A plurality of modular containers that can be interconnected, for multiple uses in accordance with claim 19, wherein said central cavity of the concave bottom is inwardly provided with a threaded portion compatible with a threaded portion of the neck of the bottle.

21. A plurality of modular containers that can be interconnected, for multiple uses in accordance with claim 19, wherein the central cavity of the concave bottom is in size and shape compatible with that of the neck of the container without its cover, although with a slightly smaller interior diameter to the exterior of said neck; so that the male-female interconnection among the mentioned neck of a bottle, and the central cavity provided by the bottom of another bottle is able to take place by a forced fit through initial, but not continuous, pressure.

22. A plurality of modular containers that can be interconnected, for multiple uses in accordance with claim 19, wherein the central depression of the concave bottom is in size and shape compatible with that of the neck of the bottle without its cover, although provided of nerves that an interior diameter slightly reduced respecting the exterior of said neck; so that a male-female interconnection among the neck of a container and the central depression provided by the bottom of another container is able to take place due to a forced fit by initial, but not continuous pressure.

23. A plurality of modular containers that can be interconnected, for multiple uses in accordance with claim 2, wherein a central cavity of a concave bottom surface is in size and shape compatible with that of the neck of the bottle without its cover, although provided of nerves that reduce its interior diameter with regard to an external diameter of said cover; so that a male-female interconnection among the neck and cover of the container and the central cavity provided in the bottom surface of another container is able to take place due to a forced fit by initial, but not continuous pressure.

24. A plurality of modular containers that can be interconnected, for multiple uses in accordance with claim 1, wherein a traverse section of the container is square and is defined by the lateral walls provided of the interconnection means with other bottles of similar characteristics.

25. A plurality of modular containers that can be interconnected, for multiple uses in accordance with claim 1, wherein the lateral walls of the bottle correspond to a prism.

26. A plurality of modular containers that can be interconnected, for multiple uses in accordance with claim 1, wherein the lateral walls of the container correspond to a regular prism.

27. A plurality of modular containers that can be interconnected, for multiple uses in accordance with claim 1, wherein the lateral walls of the bottle correspond to an irregular prism.

28. A plurality of modular containers that can be interconnected, for multiple uses in accordance with claim 1, wherein the lateral walls of the bottle correspond to a prism having a square base.

29. A plurality of modular containers that can be interconnected, for multiple uses in accordance with claim 1, wherein the lateral walls of the container correspond to a prism having a square base in an octagonal shape (that is its corners slanted).

30. A plurality of modular containers that can be interconnected, for multiple uses in accordance with claim 1, wherein the lateral walls of the container correspond to a prism having an octagonal base.

31. A plurality of modular containers that can be interconnected, for multiple uses in accordance with claim 1, wherein the lateral walls of the container correspond to a prism having a trapeziform base.

32. A plurality of modular containers that can be interconnected, for multiple uses in accordance with claim 1, wherein the lateral walls of the container correspond to a prism having a circular base.

33. A method of forming block modulars from a plurality of modular containers that can be interconnected, for multiple uses and reutilization, comprising the steps of:

gathering and cleaning a plurality of disposable containers being modular containers and including a bottom surface, a top surface, and lateral walls that are joined to one another via the bottom surface and the top surface;

said top surface having a prolonged neck delimiting an access mouth to an interior of said container, said access mouth being shuttable using a cover that can be removed; wherein said lateral walls and said bottom and top surfaces possess means for lateral and top and bottom interconnection with others of the plurality of modular containers to compose structures of all types and applications;

said prolonged neck has a ring cord projecting from the periphery thereof, said ring cord is wider than said cover and has a ring groove memory that works as a retentive rim at a means for interconnection which includes compatible recesses and salients and of reciprocal fit through engaging pressure, said ring groove memory preventing rotation and spontaneous decoupling of the modular containers about the means of interconnection;

filling the interior of said plurality of modular containers at the access mouth of each container with a padded material;

sealing the padded material within the plurality of modular containers by coupling said cover with said prolonged neck;

connecting the lateral walls of the plurality of modular containers by interconnecting the means for lateral interconnection along a longitudinal sense of the plurality of modular containers to from a structural group; and connecting said bottom surface of said plurality of modular containers with said top surface of said plurality of modular container to cause said structural group to form walls.

34. The method of forming block modulars in accordance with claim 33, wherein the means for lateral interconnection are recesses and salients conformed in the lateral walls of the container as male-female engaging means, compatible to each other and disposed along said walls, and one lateral wall has recesses, and the adjacent lateral wall has salients.

35. The method of forming block modulars in accordance with claim 33, wherein the means for top interconnection include a salient conformed in the top surface of the container that is compatible with recesses conformed in the bottom surface as an external cavity, as male-female engaging means among said top surface of each container with regard to said cavity of the bottom surface of another similar container.

36. The method of forming block modulars in accordance with claim 35, wherein the means for top interconnection of a container with the cavity and central depression in the bottom of another container of similar characteristics include a neck born in the top shoulder of the container, starting from a surrounding cord that is projected to form an annular tooth of retention against an annular groove, compatibly provided by the cavity of the bottom surface.

* * * * *